US005538017A

United States Patent [19]

Webb et al.

[11] Patent Number: 5,538,017

[45] Date of Patent: Jul. 23, 1996

[54] TOBACCO LEAF SEPARATOR

[75] Inventors: Marshall W. Webb, MacClesfield; Robert T. Monk, Jr., Farmville, both of N.C.

[73] Assignee: Monk-Austin International, Inc., Farmville, N.C.

[21] Appl. No.: 314,426

[22] Filed: Sep. 28, 1994

[51] Int. Cl.[6] ..... A24B 3/16

[52] U.S. Cl. ..... 131/110; 209/21; 209/639

[58] Field of Search ..... 131/108–110; 209/136, 138, 639, 642, 21

[56] References Cited

U.S. PATENT DOCUMENTS 4,465,194 8/1984 Coleman .
4,475,562 10/1984 Thatcher et al. .
4,618,415 10/1986 Vecchio et al. .
4,627,447 12/1986 Brackmann et al. ..... 131/109.1
4,701,256 10/1987 Cross, Jr. .
4,755,284 7/1988 Brooks et al. .
4,915,824 4/1990 Surtees .
4,932,423 7/1990 Lauenstein et al. .
5,099,863 3/1992 Coleman .
5,205,415 4/1993 Surtees .
5,325,875 7/1994 Coleman et al. .

*Primary Examiner*—Jennifer Bahr
*Attorney, Agent, or Firm*—Rhodes, Coats, & Bennett

[57] ABSTRACT

A mixture of tobacco leaf lamina and stem is separated in an apparatus having a first separation chamber in which the mixture is projected through an air stream by a first impeller and an intermediate mixture segment is projected back through the air stream from the bottom of a return impeller on the opposite side of the chamber. A stem segment is discharged directly from the lower part of the first separation chamber into a second separation chamber in which the mixture is projected across the chamber through a second air stream, and a second mixture segment is projected from beneath a return impeller back through the second air stream.

10 Claims, 2 Drawing Sheets

TOBACCO LEAF SEPARATOR

BACKGROUND OF THE INVENTION

The present invention relates to a method and apparatus for air classifying or separating the lamina and stem of threshed tobacco leaves by passing a mixture of tobacco leaf particles through an upwardly moving air stream to carry the light particles upwardly, while allowing the heavy particles to fall downwardly.

In the processing of leaf tobacco into a state suitable for use in the manufacture of tobacco products, e.g., cigarettes, it is necessary to separate the lamina from the stem in the leaf structure. After separation, these elements are separately treated before use. This separation is normally accomplished by first threshing the tobacco, i.e., cutting or tearing the lamina from the leaf stem. As used herein, the term "stem" includes both the main stem and side veins of the tobacco leaf. The resultant mixture of lamina and stem pieces is fed to an air separator or classifier to segregate the lamina pieces from the stem pieces.

In an air separator, air is blown upwardly from the lower part of a chamber into contact with the leaf mixture, which is projected across the chamber substantially perpendicular to the direction of the air stream. Since lamina particles have a larger surface area to weight ratio than stein particles, the air stream exerts a relatively greater lift on the lamina particles. The velocity of the air stream is adjusted so that the lamina particles are carried upwardly and out of an exit opening near the top of the chamber, while the stein particles fall to the bottom of the chamber, where they are removed through a lower opening. Thus, lamina and stem particles are separated.

Unfortunately, this separation process does not operate with complete efficiency, and some lamina particles, especially if they are still attached to small pieces of stern, are not separated from the stem particles. To achieve more complete separation, air separators have been modified so that the residual leaf mixture, i.e., material not discharged as lamina, is again subjected to an air stream. One way to achieve this additional separation is to again pass the leaf mixture through the air stream in the same chamber, e.g., by redirecting the leaf mixture back across the chamber through the air stream.

An example of a multi-pass separator is found in U.S. Pat. No. 4,465,194 to Coleman, which discloses a tobacco leaf separator having a primary chamber and a secondary chamber. The primary chamber has a rear wall, a front wall, and a lamina discharge port at the top of the chamber. An air-permeable conveyor extends from the rear wall of the chamber to the front wall. A tobacco inlet including a first winnower is positioned in the rear wall above the conveyor. A second winnower is positioned adjacent the front wall above the conveyor, below the level of the first winnower.

In the operation of the Coleman apparatus, a mixture of lamina and stem is introduced into the primary chamber through the tobacco inlet and projected to the front wall of the chamber by the first winnower. An air stream is conveyed through the permeable conveyor, upwardly through the primary chamber, and out the lamina discharge port. Lighter lamina is carded by the air stream upwardly through the discharge port. Material striking the front wall drops onto the second winnower which rotates away from the front wall to project the collected particles from the top of the winnower back across the separation chamber, again subjecting the particles to the air stream to separate lighter particles from heavier particles. Particles on the conveyor belt are conveyed into the secondary chamber, where they are once again subjected to the air stream to carry lighter particles up to the lamina discharge port. Heavier particles drop into a stem discharge opening.

Another example of a multi-pass separator is found in U.S. Pat. No. 4,701,256 to Cross, Jr. which describes a separator having a tobacco inlet with a winnower in a back wall, an inclined air-permeable ramp extending from a front wall toward the back wall, and an air impeller located at the top of the ramp adjacent the front wall, at a level below the plane of the tobacco inlet. In operation, air is conveyed upwardly through the inclined ramp and the separation chamber, and tobacco is propelled across the chamber from the tobacco inlet. Lighter particles are conveyed by the air stream out of the top of the chamber, while heavier particles strike the front wall and fall to the air impeller, which propels these latter particles outwardly across the chamber, and again into the air stream for separation.

U.S. Pat. No. 4,475,562 to Thatcher et al describes a tobacco separator having a tobacco inlet in one wall, and an air inlet communicating with a source of air positioned in the separator wall opposite the tobacco inlet and beneath the horizontal plane of the tobacco inlet. A downwardly and inwardly projecting member extends from the separator wall above the air inlet opposite the tobacco inlet. In operation, tobacco is projected upwardly into the chamber from the tobacco inlet and air is introduced into the chamber upwardly from the air inlet. The tobacco stream is contacted by the air stream, which separates the tobacco into a lighter fraction which is carded upwardly in the chamber and out of the lamina outlet, while the heavier tobacco fraction, a portion of which strikes the opposite wall, drops downwardly onto the inclined member. From there, the heavier fraction falls from the lower end of the inclined member, and is again subjected to the force of the air stream to again effect separation. Finally, the heavier fraction drops to the bottom of the chamber for collection. The lamina fraction is conveyed to another separator.

The leaf mixture may also be subjected to an additional separation by discharging the tobacco particles from the first chamber into one or more additional chambers having a similar configuration. For example, U.S. Pat. Nos. 5,099,863 to Coleman and 5,325,875 to Coleman et at, describe a system comprised of a plurality of air separators connected in a front-to-back relationship. Each separator includes a back wall, a front wall, and a lamina receiving and discharge means positioned in the top of the separator. A conveyor belt is positioned in the bottom of the chamber, inclining upwardly from the back wall to the front wall. A tobacco inlet port containing a winnower is positioned in the back wall of the separator adjacent the conveyor.

In operation, air is projected upwardly through the conveyor and the separator chamber, and tobacco is discharged upwardly into the conveyor from the tobacco inlet port. Lighter particles are conveyed by the air upwardly in the chamber where they are received and discharged, while heavier particles are conveyed by the conveyor to a discharge port, which also serves as the tobacco inlet port for the adjacent downstream separator which is of a similar construction.

The above U.S. Pat. No. 5,325,875 to Coleman et al also describes a series of front-to-back separators, each of which, except for the last separator, have a first winnower located in the back wall above the conveyor, and a second winnower located adjacent the front wall above the conveyor, but below the level of the first winnower. A tobacco discharge port is located in the front wall of the separator above the second winnower and approximately on a horizontal plane with the first winnower. This tobacco discharge port also serves as the tobacco inlet for a second separator of similar construction. The discharge port of the second separator serves as the inlet port for a third separator of similar construction, except that the discharge port of the third separator is at the bottom of the separator beneath the end of the conveyor. A common conveyor extends beneath all three separators.

In operation, tobacco entering the first separator is separated by the air stream, with the lightest lamina being carded by the air stream to the top of the separator and the heaviest particles falling onto the conveyor. Particles of intermediate density are projected directly across the separator and into the tobacco outlet for further treatment in the second separator, while another portion drops onto the second winnower, which propels the particles back into the air stream from the top of the second winnower for additional separation. This process is repeated in the second separator, and in the third separator, except for the fact that all intermediate particles fall onto the second winnower in the third separator. Importantly, only the middle portion of the tobacco mixture is conveyed to the next separator, while the heavier portion, which my also contain lamina, receives no further treatment.

Another air separation system comprised of a plurality of air separators in series connected by a common conveyor is described in U.S. Pat. No. 5,205,415 to Surtees. In each separator, tobacco is projected across the separation chamber from a tobacco inlet in the rear wall and air is directed upwardly into the chamber through the conveyor belt. The tobacco is separated into a light fraction which is carried out the top of the separation chamber, a heavy fraction which falls onto the conveyor, and an intermediate fraction which is carded across the separator chamber and out a discharge port that forms the tobacco inlet port of the next separator.

An air separation system combining the multi-pass separation of a single chamber with the separation achieved by passing the tobacco mixture through a plurality of front-to-back chambers would provide even greater separation efficiency. However, connecting multi-pass separators together so that all of the non-lamina material is conveyed to a second separator has not proved to be practical. In air separators, at least a part of the leaf mixture, i.e., the leaf material remaining after separation of lamina, is collected adjacent the bottom of the separator chamber. In order to treat this material in a second separator, the material must be introduced into the second separator at a level which is above the level of the discharge point in the first separator.

Theoretically, the discharge outlet of the first separator could be connected to the inlet of the second separator by a conduit. Movement of lamina through a conduit, however, causes breakage or degradation of the lamina, decreasing its usefulness. Thus, this approach is not practical. It would also be theoretically possible to simply raise the first separator to a height where the discharge outlet of the first separator was at a level with the inlet of the second separator. The discharge, and intake ports could then be connected without the need for a conduit.

Conventional separators, however, are quite large, normally having a height of over 13 feet above floor level. The normal vertical distance between the discharge port and the intake port is almost 8 feet. Therefore, it would be necessary to raise the first separator about 8 feet about floor level, resulting in the top of the first separator being about 21 feet about the floor. Not only would the operator have to climb to this height to observe the interior of the first separator and make any alterations in its set-up, which would be time-consuming and possibly dangerous, but existing processing facilities simply do not have ceiling which are this high. Thus, if this system was to be installed in an existing processing facility, it would be necessary to raise ceiling heights, resulting in considerable cost, as would the heating or cooling of the additional space.

An air separator in which a mixture of tobacco leaf lamina and stem could be subjected to multiple exposures to an air stream in a treatment chamber, and which could be connected in series to a similarly constructed separators without a conduit so that all residual leaf mixture could be subjected to air streams in multiple chambers would be of great value in the pertinent industry. An air separator of this construction that could be installed in existing processing facilities would be of particular value.

Thus, one aspect of the present invention is to provide an improved air separator in which a mixture of tobacco leaf lamina and stein is subjected to multiple passes through an upwardly moving air stream to discharge lamina from the upper part of the separator and all non-lamina material from adjacent the bottom of the separator, directly into the intake of a second separator.

Another aspect of the present invention is to provide a series of milti-pass air separators in which the leaf mixture discharge outlet of one separator is directly connected to the leaf mixture intake of a second separator, with the series of separators being of a height such that they can be installed in a existing processing facility.

Still another aspect of the present invention is to provide a method for subjecting a mixture of tobacco leaf lamina and stem to multiple separations in a single chamber, and separations in a plurality of air separator chambers.

These and other aspects of the present invention will be obvious to one skilled in the art upon a reading of the Summary of the Invention and the Detailed Description of the Invention which follow.

SUMMARY OF THE INVENTION

The present separator comprises a separation chamber having back front, side, and upper walls. The chamber includes an upper opening through which lamina is removed from the separator. The separator also includes a lower chamber through which air is introduced and leaf material is removed.

The leaf mixture is introduced into the separation chamber through an opening in the back wall of the chamber, and is propelled across the chamber along a substantially horizontal path from the bottom of a rotary impeller or winnower communicating with the interior of the chamber through the leaf mixture opening. The winnower is comprised of a rotatable horizontal shaft having a plurality of spaced, outwardly extending vanes with flexible edges adapted to brash against a curved inner wall during rotation.

A discharge outlet is located in the lower front wall of the chamber for removal of residual leaf material from which lamina has been partially separated. An air-permeable conveyor is positioned beneath the separation chamber to collect material falling from the separation chamber. This conveyor belt is inclined downwardly from the back wall toward the front wall of the chamber, with its discharge end positioned above the discharge outlet. A source of air, not shown, blows air upwardly through the separation chamber along a path substantially perpendicular to the path of the leaf mixture.

In order to expose the leaf mixture twice to the air stream, and thus achieve greater separation, the leaf material is projected back across chamber by a redirecting impeller positioned adjacent the front wall at a level beneath the horizontal plane of the leaf mixture inlet. Leaf material which has an intermediate surface to weight ratio will be projected across the chamber, where it will be received at the top of the redirecting impeller and projected back across the chamber from the bottom of the impeller.

The preferred impeller is a rotary impeller comprised of a rotatable, horizontal vaned shaft mounted parallel to and spaced from the front wall, and a deflector plate having a curved wall extending from the front wall into the chamber beneath the vaned shaft. The shaft preferably has a plurality of equally spaced, outwardly projecting vanes projecting toward the curved wall. The lower, inner end of the curved wall is substantially horizontal. A hinged deflector is attached at the inner end of the curved wall to control the angle of discharge of material into the chamber. A powered drive source, is provided to rotate the shaft toward the from wall, so that the vanes brash leaf material downwardly along the front wall and curved wall, projecting the leaf mixture along a substantially horizontal path back across the chamber.

Prior art air separators that include redirecting means have projected leaf material back into the chamber from the top of the redirecting means, resulting in the need for a separation chamber having a considerable height. With the present redirecting means, however, the height of the separation chamber, and thus the overall height of separator is significantly less. Therefore, a separation system constructed of two of these separators in front-to-back relationship has a substantially reduced height allowing the system to be installed within existing facilities.

Specifically, the air separator system of the present invention is comprised of a first air separator of the above description joined in front-to-back relation to similarly constructed second separator by raising the first separator to a desired level and attaching the material outlet of the first separator to the material inlet of the second separator.

Separation of a leaf mixture comprised of lamina and stem particles is achieved by projecting the leaf mixture substantially horizontally across the separation chamber toward the chamber's front wall. Air is blown upwardly introduced through the chamber and into contact with the leaf mixture. The lamina segment, comprised of a percentage of the lamina from the leaf mixture, is conveyed upwardly and out of the chamber through a lamina discharge opening for further processing. The heavier stem segment comprised of stem particles and a small percentage of lamina drops to the conveyor. The intermediate segment comprised of a mixture of stem, and lamina is propelled across chamber and into contact with the chamber's front wall.

Upon striking the front wall, this intermediate segment falls onto the top of the redirecting impeller and between the impeller and the front wall. The material is then carried to the bottom of the redirecting means and is projected therefrom in a rearward direction back across the air stream for further separation. Upon being contacted again by the air stream, the leaf mixture is divided into a lighter lamina segment which is carried upwardly to the lamina discharge port, and a heavier stem segment which falls onto the conveyor belt and is discharged from the bottom of the separator through the stem discharge opening.

The stem segment, which still contains recoverable lamina, is transferred directly from the discharge opening of the first separator into the leaf inlet of a second separator, in which the separation procedure described for the first separator is repeated. That is, the leaf mixture is contacted with an upwardly moving air stream to separate the leaf mixture into a lighter segment removed from the top of the chamber, a heavier segment which falls to the bottom of the chamber, and can intermediate segment.

This intermediate segment, as in the first chamber, drops onto the top of the redirecting impeller and is propelled back across the chamber along a substantially horizontal path from the bottom of the redirecting means for further separation in the air stream. Heavier stem material, with lamina separated therefrom, along with the stem segment from the first pass of the leaf mixture through the air stream, is removed from the bottom of the chamber.

DETAILED DESCRIPTION OF THE PREFERRED EMBODIMENT

Figure 1:
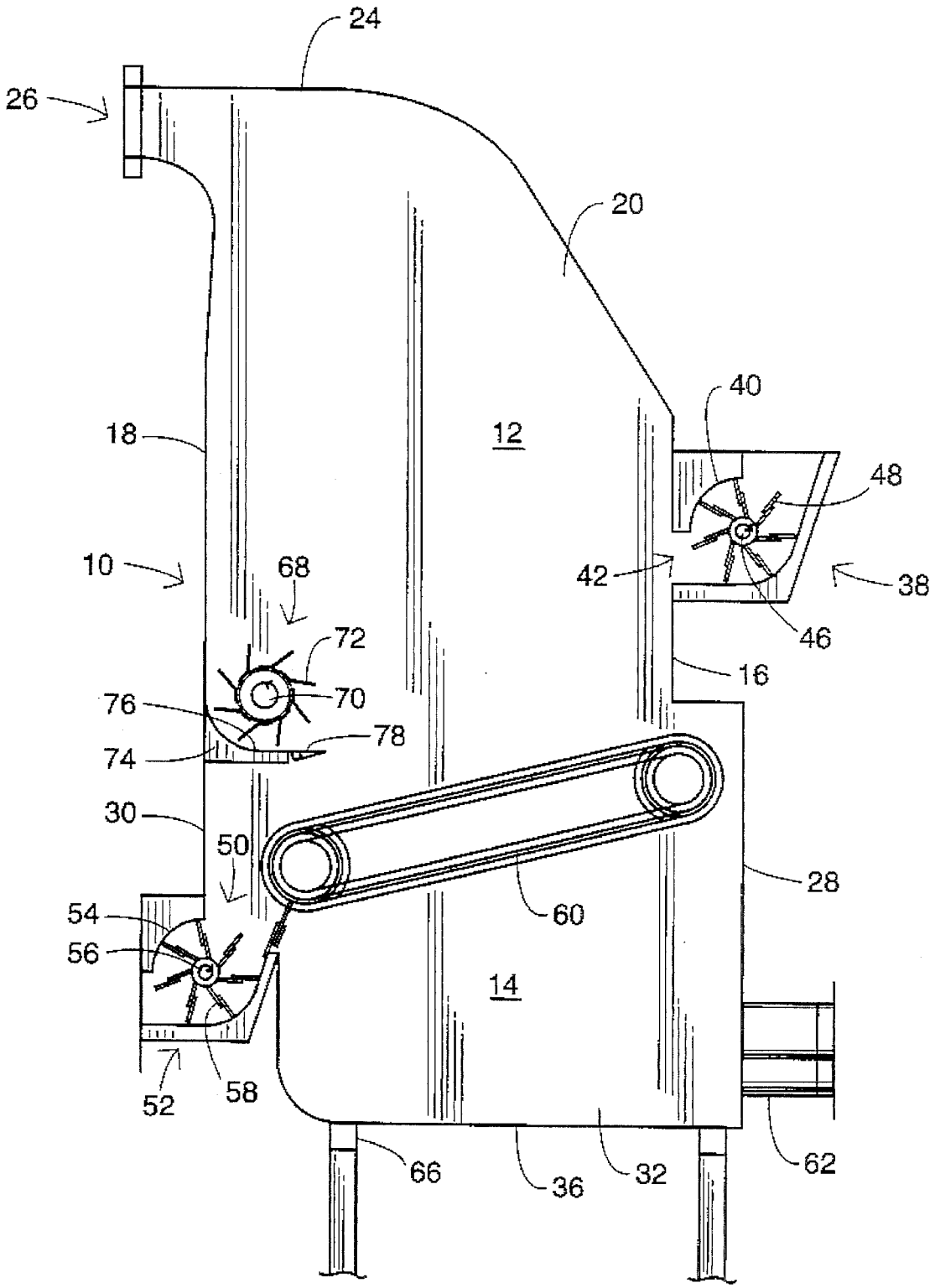
FIG. 1 is a sectional side view of the separator of the present invention.

In the following description, terms such as horizontal, upright, vertical, above, below, beneath, and the like, are used solely for the purpose of clarity in illustrating the invention, and should not be taken as words of limitation. Similar reference characters are used to identify corresponding parts.

Air separator 10, as best shown in FIG. 1, is comprised of an upper separation chamber 12, and a lower chamber 14 into which air is introduced and residual leaf material, mainly stem, is removed. Chamber 12 is comprised of a back wall 16, a front wall 18, side walls 20 and 22, a curved upper wall 24, and a lamina discharge opening 26, through which lamina is removed from the separator. Lower chamber 14 is comprised of a back wall 28, a front wall 30, side walls 32 and 34, and a bottom wall 36. Walls 28–34 are joined at their tops edges to the lower edges of walls 16–22, respectively, to form an enclosed chamber.

A winnower 38 having a curved inner wall 40 is mounted outside chamber 12 on back wall 16, and communicates with the interior of chamber 12 through opening 42. Winnower 38 is comprised of a rotatable horizontal shaft 46 having a plurality of spaced, outwardly projecting vanes 48 with flexible edges adapted to pass against a spaced inner wall 40 during rotation of shaft 46. The vanes project at an angle of about 20°–30° behind radial so that the material is projected from the tips of the vanes, achieving the greatest projection velocity at the speed of rotation.

A material discharge outlet 50 is located in front wall 30 in communication with a second winnower 52, which includes a curved inner wall 54. A rotatable, horizontal shaft 56 having a plurality of spaced, outwardly projecting vanes 58 with flexible edges thereon adapted to brush against inner wall 54 during rotation of shaft 56. Winnower 52 is similar in construction to winnower 38 and, as will be discussed in greater detail later, can project leaf material from separator 10 into the separation chamber of a second separator.

An air-permeable conveyor belt 60, formed of perforated steel sections supported on a chain, is positioned along the upper part of chamber 14 beneath upper chamber 12, so that any material falling from chamber 12 will drop onto the upper surface of belt 60. Belt 60 is inclined downwardly from back wall 28 toward from wall 30 at an angle of 12°, causing the material will float along the belt surface toward the discharge end. The discharge end of belt 60 is positioned above outlet 50, so that material discharged from belt 60 falls into outlet 50.

An air conduit 62 communicates with the interior of chamber 14 through back wall 28 to provide pressurized air into chamber 14. Since conveyor belt 60 is air-permeable, air will flow through belt 60 from chamber 14 and upwardly through chamber 12. A deflector plate 64 projects upwardly from outlet 50, and has a flexible outer edge engaging belt 60, so that air will not flow upwardly between belt 60 and outlet 50. A base 66 supports air separator 10 at the desired level above the floor.

In order to project the intermediate leaf mixture back across chamber 12, and thus obtain the advantages of multi-pass treatment, a redirecting impeller or winnower 68 is positioned adjacent front wall 18 at a level beneath the horizontal plane of winnower 38. Winnower 68 is comprised of a rotatable, horizontal shaft 70 mounted parallel to and spaced from front wall 18, and a plurality of equally spaced, outwardly projecting vanes 72 attached to shaft 70. Shaft 70, which rotates toward wall 18, is spaced from wall 18 at a distance such that the outer ends of vanes 72 move downwardly along wall 18 when shaft 70 is rotated. Vanes 72 extend substantially tangentially from shaft 70, so that they contact wall 18 at an angle of about 30° behind radial to maximize the thrust of the material back across the chamber. The tips of vanes 72 are positioned as close as possible to wall 18, e.g., within about ¼ inch, to sweep material along the wall without jamming the impeller.

A deflector plate 74 is positioned beneath shaft 70 with a curved wall 76 spaced from shaft 70 a distance such that the tips of vanes 72 brush downwardly along wall 76 during rotation of shaft 70. Deflector plate 74 includes a hinged tip 78, to control the angle of discharge of material into chamber 18. Wall 76 and shaft 70 form an annular channel through which material is first conveyed downwardly, and then into chamber 12. Deflector plate 74 extends over the discharge end of conveyor belt 60.

Due to the unique construction, positioning and operation of winnower 66 and deflector plate 74, the overall height of chamber 12, and thus separator 10, is significantly less than the corresponding height of other air separators. Specifically, separator 10 has a height of only slightly over 11.5 feet, as opposed to a conventional air separator which has a height of over 13 feet. Also, the distance between the material inlet and material outlet, because of the unique configuration of the impeller, is less than 4 feet. Therefore, it is possible to join the outlet of one separator to the inlet of a second similar separator, with an inlet rotor in the second inlet having a height of about 1 foot, resulting in a combined unit with a total height of less than 16.5 feet. Thus, the separator system can be constructed within existing facilities. Furthermore, if stacking of three separators in front-to-back configuration is desired, the total height of triple separator will be less than 21.5 feet.

Figure 2:
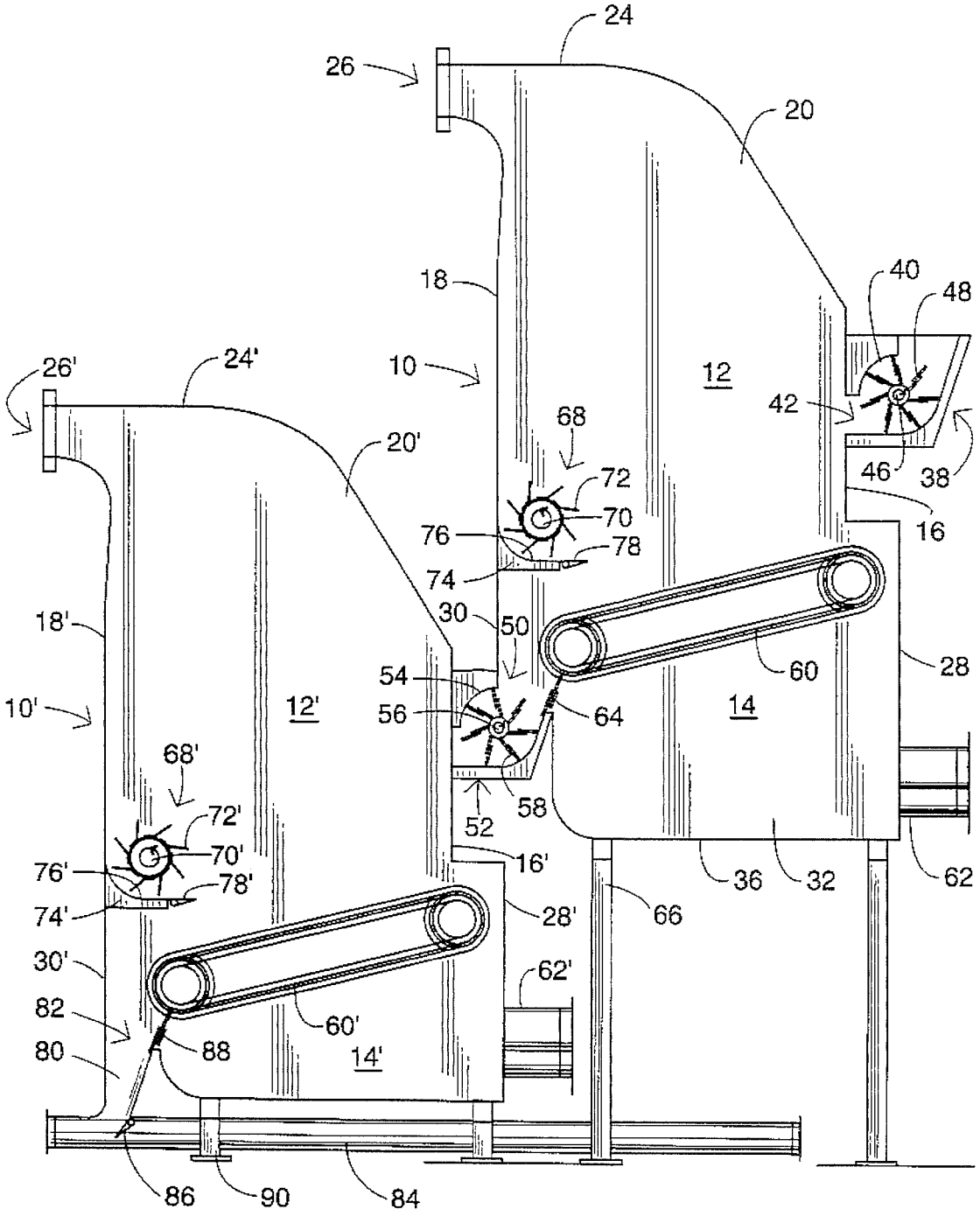
FIG. 2 is a sectional side view of an air separator system comprised of the separator of FIG. 1 joined in front-to back relationship with a second similar separator.

This air separator system is shown in FIG. 2, in which air separator 10 is joined in front-to-back relation to similarly constructed separator 10', comprised of an upper and lower chambers 12' and 14', so that material is discharged from the discharge outlet of the first separator directly into the inlet of the second separator onto the impeller located in the second separator inlet. Chamber 12' also includes a front wall 18', side walls 20' and 22', a curved upper wall 24', and a lumina discharge opening 26'. Lower chamber 14' is comprised of back wall 28', front wall 30', side walls 32' and 34', and bottom wall 36'.

A downwardly extending, material discharge conduit 80 is mounted on outside chamber 14' on front wall 30', communicating with the interior of chamber 14' through opening 82. Conduit 80 discharges into a pneumatic conveyor 84. An adjustable deflector plate or damper 86 is positioned at the junction of conduit 80 and conveyor 84 to control air velocity.

An air-permeable conveyor belt 60' is positioned along the upper part of chamber 14' beneath upper chamber 12', to receive material falling from chamber 12'. Belt 60' is inclined downwardly from back wall 28' toward front wall 30' at an angle of 12° , with its discharge end positioned above outlet 82, so that material discharged from belt 60' will fall into outlet 82, for removal by conveyor 84.

An air conduit 62' communicates with the interior of chamber 14' through back wall 28'. Deflector plate 88 projects upwardly from outlet 80, and has a flexible outer edge engaging belt 60'. Base 90 supports air separator 10' at the desired level above the floor.

Non-lamina particles are projected back across chamber 12' by redirecting impeller 68' positioned adjacent front wall 18 at a level beneath the horizontal plane of winnower 52. Winnower 68' is comprised of a rotatable, horizontal shaft 70' mounted parallel to and spaced from front wall 18', and a plurality of equally spaced, outwardly projecting vanes 72' attached to shaft 70'.

Deflector plate 74', mottoted beneath winnower 68', has a curved wall 76' spaced from shaft 70' to form an annular channel through which material is first conveyed downwardly, and then into chamber 12. Vanes 72' pass adjacent wall 76' with a brushing action during rotation of shaft 70'. Deflector plate 74' terminates in an adjustable, hinged tip 78' to control the angle of discharge of material into chamber 18.

In operation, a leaf mixture comprised of lamina and stem particles is introduced into chamber 12 through opening 42. Vanes 48, mined on shaft 46, propel the leaf mixture horizontally across chamber 12 and toward front wall 18. At the same time, air is introduced into chamber 14 through conduit 62, mid flows upwardly through conveyor 60 into chamber 12, where it impacts on the leaf mixture being projected across the chamber.

Since the lamina and stem have different surface to weight ratios, the air stream tends to exert a greater lift on the lamina. The velocity of the air stream is controlled such that a percentage of the lamina particles are conveyed upwardly and out of the chamber through 26, where they are received for further processing. Heavier particles, mainly stem, but also a small percentage of lamina, drops to conveyor 60.

Particles having an intermediate surface to weight ratio are propelled across chamber 12 and impact front wall 18, falling down onto winnower 68 and between winnower 68 and wall 18. As winnower shaft 70 rotates toward wall 18, as shown by the arrow, these particles are moved downwardly between wall 18 and winnower 68, and then between winnower 68 and deflector plate 74. As the mixture exist the channel between winnower 68 and plate 74, they are projected back into chamber 12 along a substantially horizontal path beneath the horizontal plane of winnower 38, and are again impacted by the air stream. Once again, a pan of the lamina in the leaf mixture is carded upwardly by the air stream and out of lamina discharge port 26, while the remainder of the leaf mixture falls onto conveyor belt 60.

Leaf material falling onto conveyor 60, either from the first separation or the second separation is moved to the end of conveyor 60 and falls into opening 50 into contact with winnower 52. The process which took place in the first air separator is then substantially repeated, with the leaf material being propelled by vanes 58 of winnower 52 substantially horizontally across chamber 12', where it is subjected to the force of air flowing upwardly through conveyor 60' into chamber 12'. Lamina particles are conveyed upwardly and out of chamber 12' through opening 26'. Heavier particles fall to conveyor 60.

Intermediate particles, propelled across chamber 12' by winnower 52, strike front wall 18', and drop onto winnower 68', which rotates toward wall 18', to propel the intermediate particles back into chamber 12' along a substantially horizontal path beneath the horizontal plane of winnower 52, where they are again impacted by the air stream. The separated lamina is carried upwardly by the air stream and out of lamina discharge port 26'. The remainder of the leaf mixture, now mainly stem, falls onto conveyor belt 60' and is removed through discharge opening 82 and conduits 80 and 84 for subsequent processing.

Certain modifications and improvements will occur to those skilled in the an upon a reading of the foregoing description. By way of example, different redirecting impellers other than that specifically described can be used, so long as the material is collected at the top of the impeller and projected back across the chamber from the bottom of the impeller. Also, more than two separators can be joined in front-to-back relationship when ceiling height is not a consideration, and the separator can be used as a single unit. It should be understood that all such modifications and improvements have been deleted herein for the sake of conciseness and readability but are properly within the scope of the follow claims.

What is claimed is:

1. An air separator for separating a mixture of tobacco leaf lamina and stem into lighter and heavier segments comprising:

(a) a separation chamber having an upper end including a lighter segment discharge opening, a back wall including a leaf mixture inlet and a front wall including a heavier segment discharge opening;

(b) a first rotatable impeller at said back wall adjacent said mixture inlet to propel a mixture of tobacco leaf lamina and stem toward said front wall along a first pathway across said chamber;

(c) a second rotatable impeller at said front wall above said segment discharge opening having a deflecting surface and a rotatable vaned shaft above said surface adapted to brash a segment of said mixture along said deflecting surface in the direction of said rear wall, whereby an intermediate segment of said mixture falling from said front wall onto said impeller will be propelled across said chamber along a second pathway beneath said first pathway;

(d) a conveyor in the lower end of said chamber, said chamber having a discharge end above said heavier segment discharge opening and beneath said second impeller; and (e) a single air supply beneath said conveyor for blowing air upwardly through said chamber into contact with said tobacco mixture in said first pathway and said segment in said second pathway.

2. The separator of claim 1, wherein said deflecting surface curves downwardly from said front wall toward said rear wall.

3. The air separator of claim 2, wherein said vanes project behind radial from said shaft.

4. The air separator of claim 1, wherein said deflecting surface includes a hinged end toward said rear wall.

5. An apparatus for separating a mixture of tobacco leaf particles into lighter and heavier segments comprising:

(a) a chamber having an upper end including a lighter segment discharge opening, a front wall including a heavier segment discharge opening and a back wall including a leaf mixture inlet;

(b) a first winnower adjacent said mixture inlet adapted to project said mixture from said inlet along a first pathway across said chamber, said first winnower comprising a horizontal rotatable shaft, a curved wall extending beneath said shaft and terminating in said chamber, and flexible vanes extending from said shaft toward said wall;

(c) a second winnower adjacent said front wall above said segment discharge opening, said second winnower comprising a horizontal rotatable shaft, a curved wall extending from said front wall beneath said shaft, and flexible vanes extending from said shaft toward said wall, said winnower being rotatable toward said wall, whereby an intermediate segment of said mixture falling from said front wall onto said winnower will be carried by said vanes along said wall and propelled therefrom across said chamber along a second pathway beneath said first pathway;

(d) a conveyor in the lower end of said chamber, said chamber having a discharge end above said heavier segment discharge opening and beneath said second winnower; and (e) a single air supply beneath said conveyor for blowing air upwardly through said chamber into contact with said tobacco mixture in said first pathway and said segment in said second pathway.

6. The apparatus of claim 5, wherein the curved wall of said second winnower includes an adjustable deflector at its rear end.

7. An apparatus for separating a mixture of tobacco lamina and tobacco stem comprising:

(a) a first separation chamber having a back wall including a leaf mixture inlet, a lamina discharge outlet, a front wall having a leaf mixture discharge outlet, a first inlet impeller to project a mixture of tobacco lamina and stem across said chamber from said inlet, and a first rotatable return impeller at said from wall above said leaf mixture discharge outlet to project a segment of said mixture back across said chamber from beneath said return impeller, and a single air supply adapted to blow air upwardly through said first separation chamber into contact with said mixture and said segment; and (b) a second separation chamber having a back wall including a leaf mixture inlet adjacent the leaf mixture discharge outlet of said fast separation chamber, a lamina discharge outlet, a front wall having a leaf mixture discharge outlet, a second inlet impeller to project a mixture of tobacco lamina and stem across said chamber from said leaf mixture inlet, and a second rotatable return impeller at said front wall above said leaf mixture discharge outlet to project a portion of said mixture back across said chamber from beneath said return impeller, and a single air supply adapted to blow air upwardly through said second separation chamber into contact with said mixture and said segment.

8. The apparatus of claim 7, wherein each return impeller is comprised of a rotatable shaft having flexible vanes projecting outwardly therefrom and a curved wall spaced beneath said shaft and terminating in the direction of said separator inlet.

9. The apparatus of claim 7, wherein said second inlet impeller is within the inlet of said second separation chamber, and said discharge outlet of said first separation chamber is in direct communication with said inlet, whereby material is discharged from said discharge outlet directly to said second impeller.

10. A method for separating a fixture of tobacco leaf lamina and stem into lighter and heavier segments comprising:

(a) providing a separation chamber having an upper end including a lighter segment discharge opening, a back wall including a leaf mixture inlet and a front wall including a heavier segment discharge opening, said chamber including a first rotatable impeller at said back wall adjacent said mixture inlet, and a second rotatable impeller at said front wall above said segment discharge opening;

(b) providing a conveyor in the lower end of said chamber, said chamber having a discharge end above said heavier segment discharge opening and beneath said second impeller;

(c) contacting said first impeller with said mixture while rotating said first impeller to project said mixture from said mixture inlet along a first pathway across said chamber;

(d) receiving a segment of said mixture on the upper surface of said second impeller while rotating said second impeller toward said front wall, and projecting said segment along a second pathway across said chamber from beneath said second impeller, said second pathway being beneath said first pathway; and (e) blowing a single air stream upwardly form beneath said conveyor through said chamber and substantially perpendicular to said pathways and into contact with said tobacco mixture and said segment.

* * * * *